US006941916B2

(12) United States Patent
Sigerud et al.

(10) Patent No.: US 6,941,916 B2
(45) Date of Patent: Sep. 13, 2005

(54) AUTO ENRICHENER

(75) Inventors: Kurt Sigerud, Goodridge, MN (US); Mik Tursky, Fond Du Lac, WI (US); Ted Bettin, Thief River Falls, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 0 days.

(21) Appl. No.: 10/695,301

(22) Filed: Oct. 27, 2003

(65) Prior Publication Data

US 2005/0087173 A1 Apr. 28, 2005

(51) Int. Cl.[7] ..... F02M 1/06

(52) U.S. Cl. ..... 123/179.15; 123/580; 261/39.2; 261/39.5

(58) Field of Search ..... 123/588, 179.15, 123/581, 179.16, 580; 261/39.1–39.6

(56) References Cited

U.S. PATENT DOCUMENTS 1,958,818 A * 5/1934 Goudard ..... 261/39.2
2,093,218 A * 9/1937 Thieulin et al. ..... 261/39.2
2,156,132 A * 4/1939 Thieulin ..... 261/39.2
3,739,760 A * 6/1973 Charron ..... 123/552
3,877,448 A * 4/1975 Schmid ..... 261/39.2
3,934,571 A * 1/1976 Mennesson ..... 123/179.15

FOREIGN PATENT DOCUMENTS

JP 58-183849 * 10/1983 ..... 261/39.2

* cited by examiner

*Primary Examiner*—Tony M. Argenbright
(74) *Attorney, Agent, or Firm*—Black Lowe & Graham; Darren J. Jones

(57) ABSTRACT

An auto-enrichener for an engine, including an enriching conduit for carrying fuel and air to an engine, and a valve disposed in the conduit. The valve is adjustable between at least an open configuration and a closed configuration. In the open configuration passage of fuel and air through the conduit is enabled, and in the closed configuration passage of fuel and air through the conduit is not enabled. The auto-enrichener also includes a thermal expansion element in communication with the valve. The thermal expansion element expands with increasing temperature and contracts with decreasing temperature to activate the valve. The auto-enrichener also includes a heater that hears the thermal expansion element when the engine is operated.

24 Claims, 6 Drawing Sheets

AUTO ENRICHENER

BACKGROUND OF THE INVENTION

1. Field of the Invention

The invention relates to a method and apparatus for enriching an engine. More particularly, the invention relates to automatically and variably enriching an all terrain vehicle engine with fuel and/or air as appropriate for different engine temperatures.

2. Description of Related Art

Vehicles, such as all terrain vehicles, conventionally include an engine such as an internal combustion engine in order to enable them to move under their own power. It is sometimes useful to provide additional fuel and/or air to an engine when it is running below its normal operating temperature. This may be true particularly, though not exclusively, when the engine is being started. The process of adding additional fuel and/or air is referred to herein as "enrichment", and a device for providing enrichment is referred to herein as an "enrichener".

As the term is used herein, an "all terrain vehicle" or "ATV" is defined as a motorized vehicle suitable for travel on surfaces other than paved roads or highways (though not necessarily unsuitable for travel on highways or paved roads). ATVs travel on low-pressure tires, typically four in number, and generally have a seat designed to be straddled by an operator. The seat may be designed to support one or more additional passengers in addition to the operator, and/or there may be one or more additional seats. Typically, passengers are seated in-line behind the operator. ATVs generally use handlebars for steering control.

Unless otherwise indicated, the term "vehicle" when used herein refers specifically to an all terrain vehicle.

Instances wherein enrichment may be desirable include, for example, occasions when the vehicle's engine is started while cold. Typically, the normal operating temperature of such engines is significantly higher than the ambient temperature. When the engine is below this temperature, it may be helpful to provide the engine with additional fuel and air until such time as the engine temperature approaches its normal operating range. Once the engine reaches its operating temperature, enriching can be discontinued. Engine enrichment may be advantageous in other circumstances, as well.

It is known to manually enrich a vehicle engine. For example, a manual enrichener may be provided with a hand control, which when activated by the vehicle's operator sends additional fuel and air to the engine.

However, the manual nature of such an arrangement has several drawbacks. For example, the vehicle operator must activate the enrichener each time it is needed. If the operator does not activate a manual enrichener, no extra fuel or air will be provided. In addition, if the operator fails to deactivate a manual enrichener, or activates it when it is not needed, the engine may be supplied with unnecessarily large amounts of fuel and/or air. This may be wasteful of fuel, may make the vehicle's engine run differently than intended, etc.

A conventional manual enrichener does not in itself provide feedback to the operator as to when it should be activated. Thus, unless some feedback mechanism is provided for the operator, there may be no convenient way for the operator to tell whether enrichment is appropriate. For example, although as noted enrichment may be desirable when starting a cold engine, it may not be desirable when starting an engine that is already warm, i.e. one that was used recently and has not fully cooled down. Even assuming the vehicle operator has kept careful track of the time since the vehicle was last operated, the rate of engine cooling can depend on many factors, such as ambient temperature, wind, etc., so in many circumstances it may not be readily apparent whether the engine has cooled enough that enrichment is appropriate.

In addition, at times it may be desirable to activate the enrichener at less than full output, that is, to add fuel and air, but not at the maximum rate possible for the enrichener. For example, if the engine is started at a temperature below its operating range, but above ambient temperature, it may be preferable to enrich the engine only slightly. Similarly, it may be desirable to vary the level of engine enrichment over time, i.e. reducing it as the engine warms.

However, for a manual enrichener, any judgment of whether to enrich the engine and to what degree must be made consciously by the operator, and likewise any adjustments to the enrichment require the operator's attention.

Attempts have been made to produce an automatic enrichener. It is possible to produce an electronic enrichener that includes an engine temperature sensor, a control processor, an adjustable enrichment valve, and an actuator for adjusting the enrichment. However, such conventional devices typically are complex and expensive to manufacture and install, and have not proven entirely satisfactory.

SUMMARY OF THE INVENTION

It is the purpose of the claimed invention to overcome these difficulties, thereby providing an improved arrangement for automatically controlling engine enrichment.

An exemplary embodiment of an auto-enrichener in accordance with the principles of the present invention includes an enriching conduit for carrying fuel and air to an engine. A valve is disposed in the conduit, and is adjustable between at least an open configuration and a closed configuration. In the open configuration, passage of fuel and air through the conduit is enabled, while in the closed configuration passage of fuel and air through the conduit is not enabled.

The auto-enrichener also includes a thermal expansion element in communication with the valve. The thermal expansion element expands with increasing temperature and contracts with decreasing temperature. The thermal expansion element actuates the valve such that when the thermal expansion element is at a first temperature the valve is in the open configuration, and when the thermal expansion element is at a second temperature greater than the first temperature the valve is in the closed configuration.

A heater is arranged in thermal communication with the thermal expansion element.

The thermal expansion element may have a liquid portion disposed within a flexible solid portion, wherein the liquid portion expands with increasing temperature and contracts with decreasing temperature. The liquid portion may include silicone, and the flexible solid portion may include wax.

The heater may be an electric heater. The heater may be arranged in communication with the engine such that the heater heats the thermal expansion element when the engine is running, and the heater does not heat the thermal expansion element when the engine is not running.

The valve may include a valve plug movably engaged with the thermal expansion element, such that the thermal expansion element actuates the plug in order to actuate the valve between the open and closed positions. The valve may include a valve rod engaged with the valve plug and the thermal expansion element, such that when the thermal expansion element expands the rod and the plug are translated toward a closed position wherein passage of fuel and air through the conduit is not enabled so when valve is in the closed configuration, and when the thermal expansion element contracts the rod and the plug are translated toward an open position wherein passage of fuel and air through the conduit is enabled when the valve is in the open position.

In addition to being adjustable between the open and closed configurations, the valve may be adjustable to and from at least one intermediate configuration. In the intermediate configuration, passage of fuel and air through the conduit is enabled, but the rate of passage of fuel and air through the conduit when is less than the rate of passage of fuel and air through the conduit when the valve is in the open configuration. In such an arrangement, when the thermal expansion element is at a third temperature greater than the first temperature but less than the second temperature, the valve is in the intermediate configuration.

An auto-enrichener in accordance with the principles of the present invention may be incorporated into a vehicle, such as an all terrain vehicle.

A method for controlling engine enrichment in accordance with the principles of the present invention includes providing an enriching conduit for carrying fuel and air to an engine, and providing a valve disposed in the conduit. The valve is adjustable between at least an open configuration and a closed configuration, wherein in the open configuration passage of fuel and air through the conduit is enabled, and in the closed configuration passage of fuel and air through the conduit is not enabled.

The method includes providing a thermal expansion element in communication with the valve. The thermal expansion element expands with increasing temperature and contracts with decreasing temperature, such that the thermal expansion element actuates the valve. When the thermal expansion element is at a first temperature the valve is in the open configuration, and when the thermal expansion element is at a second temperature greater than the first temperature the valve is in, or at least is beginning to move towards, the closed configuration.

The method also includes providing a heater in thermal communication with the thermal expansion element.

The method further includes heating the thermal expansion element with the heater when the engine is running, and not heating the thermal expansion element when the engine is not running. Thus, while the vehicle is running the valve is actuated toward the closed configuration, and while the vehicle is not running the valve is actuated toward the open configuration.

The thermal expansion element may have a liquid portion disposed within a flexible solid portion, wherein the liquid portion expands with increasing temperature and contracts with decreasing temperature. The liquid portion may include silicone, and the flexible solid portion may include wax.

The heater may be an electric heater. The heater may be arranged in communication with the engine such that the heater heats the thermal expansion element when the engine is running, and the heater does not heat the thermal expansion element when the engine is not running.

The valve may include a valve plug movably engaged with the thermal expansion element, such that the thermal expansion element actuates the plug in order to actuate the valve between the open and closed positions. The valve may include a valve rod engaged with the valve plug and the thermal expansion element, such that when the thermal expansion element expands the rod and the plug are translated toward a closed position wherein passage of fuel and air through the conduit is not enabled when the valve is in the closed configuration, and when the thermal expansion element contracts the rod and the plug are translated toward an open position wherein passage of fuel and air through the conduit is enabled when the valve is in the open position.

In addition to being adjustable between the open and closed configurations, the valve may be adjustable to and from at least one intermediate configuration. In the intermediate configuration, passage of fuel and air through the conduit is enabled, but the rate of passage of fuel and air through the conduit when is less than the rate of passage of fuel and air through the conduit when the valve is in the open configuration. In such an arrangement, when the thermal expansion element is at a third temperature greater than the first temperature but less than the second temperature, the valve is in the intermediate configuration.

BRIEF DESCRIPTION OF THE DRAWINGS

Like reference numbers generally indicate corresponding elements in the figures.

DETAILED DESCRIPTION OF THE PREFERRED EMBODIMENT

Figure 1:
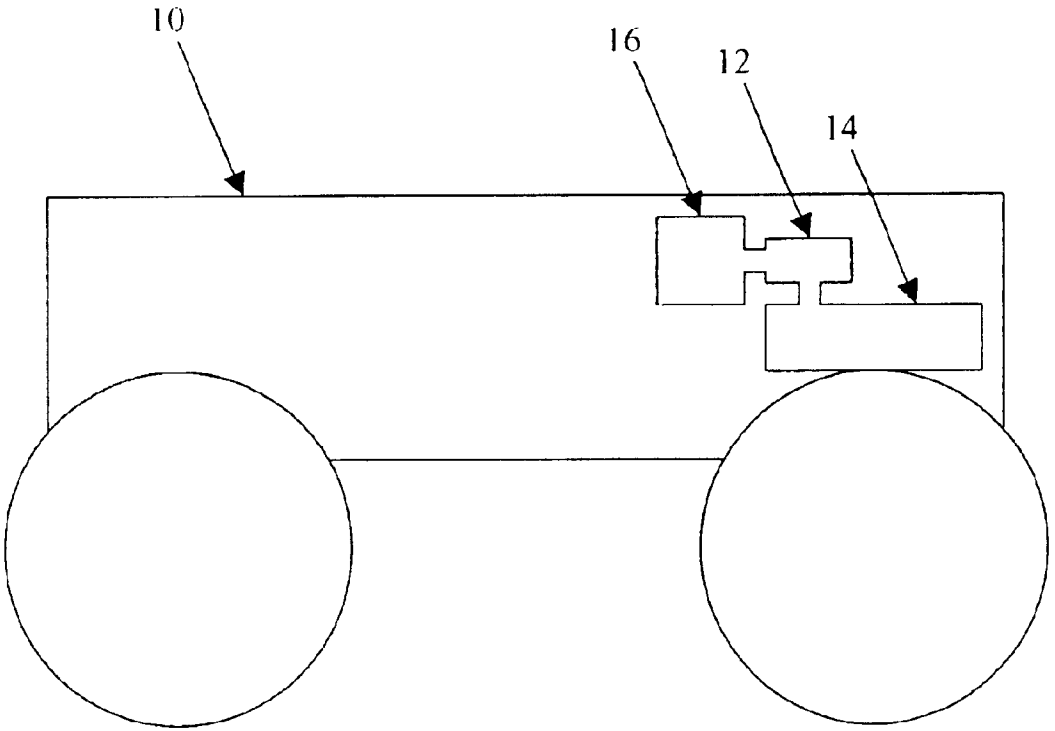
FIG. 1 shows in schematic form a vehicle having an exemplary embodiment of an auto-enrichener in accordance with the principles of the present invention.

FIG. 1 shows an all-terrain vehicle 10 with an exemplary embodiment of an auto-enrichener 12 therein. For the sake of clarity, the vehicle 10 and the components thereof are shown in schematic form. Actual all-terrain vehicles 10 may vary in size, shape, and structure.

As may be seen from FIG. 1, the auto-enrichener 12 is in communication with the engine 14 and the air/fuel supply 16. Typically, air and fuel for the normal operation of the engine 14 pass from the air/fuel supply 16 to the engine 14 without passing through the auto-enrichener 12, though this arrangement is not illustrated herein.

When the auto-enrichener 12 is in operation, additional air and fuel passes from the air/fuel supply 16 to the engine 14 via the auto-enrichener 12. When the auto-enrichener 12 is not in operation, no additional air and fuel passes from the air/fuel supply 16 to the engine 14 via the auto-enrichener 12. However, it is emphasized that the operation or lack of operation of the auto-enrichener 12 at a particular time does not necessarily affect the normal transmission of air and fuel to the engine 14. Thus, even if the auto-enrichener 12 is not in operation, air and fuel may reach the engine 14 from the air/fuel supply 16 by other routes.

Depending on the particular embodiment of the vehicle 10, a variety of engines 14 may be suitable. Suitable engines include, but are not limited to, two-stroke and four-stroke engines. Suitable engines are known per se, and are not described further herein.

Likewise, a variety of air/fuel supplies 16 may be suitable. Suitable air/fuel supplies include, but are not limited to, carburetors and fuel injectors. Suitable air/fuel supplies are known per se, and are not described further herein.

Figure 2:
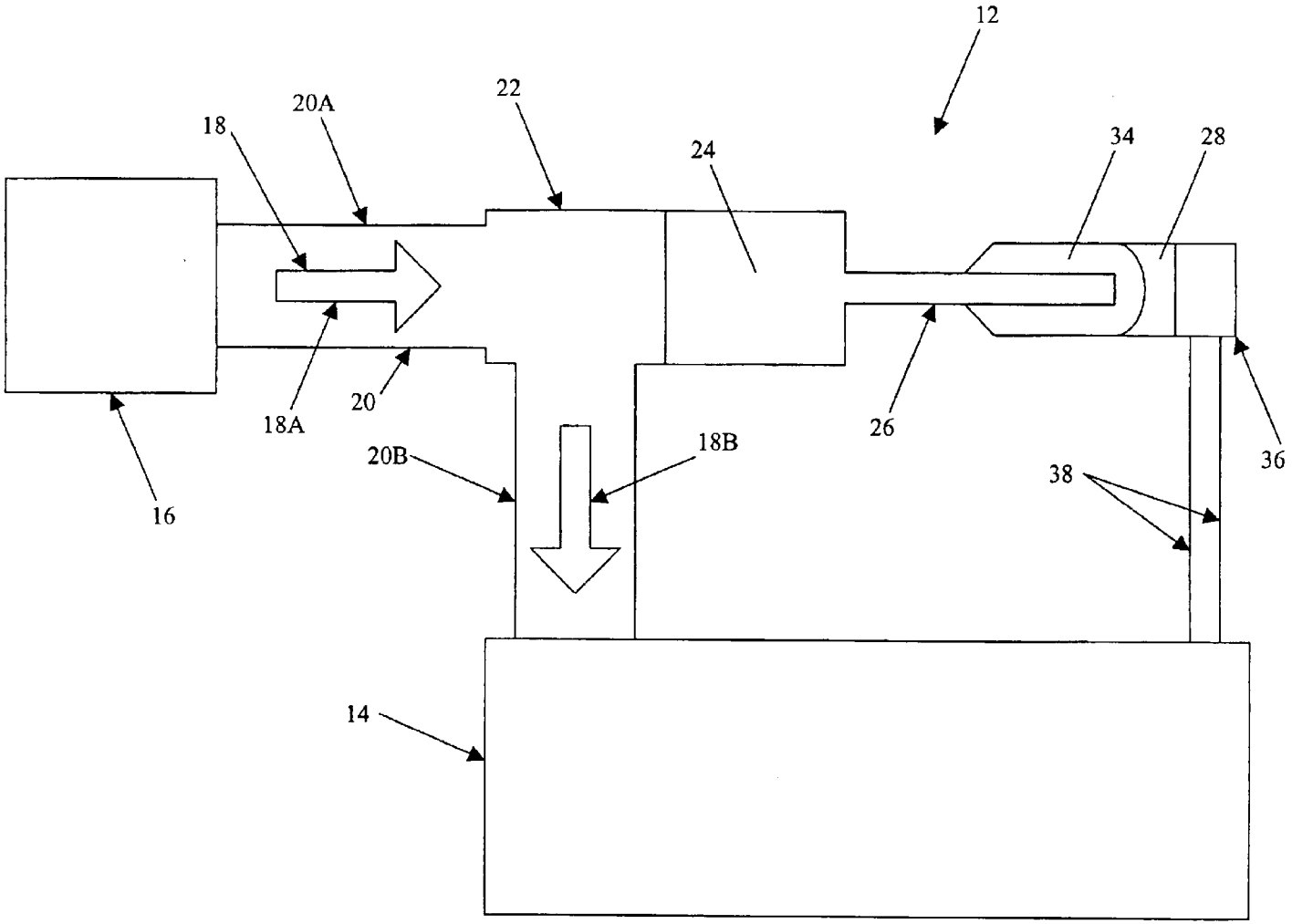
FIG. 2 shows an exemplary embodiment of an auto-enrichener in accordance with the principles of the present invention, in an open configuration.

FIG. 2 shows the auto-enrichener 12 in greater detail. As in FIG. 1, the engine 14 and the air/fuel supply 16 are shown in schematic form for simplicity.

The auto-enrichener 12 includes an enriching conduit 20, arranged to carry air and fuel to the engine 14.

A valve 22 is disposed in the conduit 20 so as to control the flow of fuel and air through the conduit 20. In the exemplary arrangement illustrated, the valve 22 is so positioned as to divide the conduit 20 into first and second sections 20A and 20B. However, this is exemplary only. Either or both the valve 22 and the conduit 20 may be configured and arranged so that there are more than two conduit sections or fewer than two sections.

The valve 22 is adjustable between at least an open configuration, wherein the passage of air and fuel into the engine 14 is enabled, and a closed configuration, wherein the passage of air and fuel into the engine 14 is not enabled.

As illustrated in FIG. 2, the valve 22 is in the open configuration. Thus, the passage of a flow 18 of air and fuel through the conduit 20 and the valve 22, and thus through the auto-enrichener 12, is enabled. In the arrangement shown, the flow 18 is illustrated in two sections. Air and fuel flow along path 18A from the air/fuel supply 16 through the first section 20A of the conduit 20 to the valve 22, and then flow along path 18B from the valve 22 through the second section 20B of the conduit 20 to the engine 14. As previously noted, such an arrangement is exemplary only. However, in such an arrangement a flow 18 of additional air and fuel is provided to the engine 14, thus enriching the engine 14.

Figure 3:
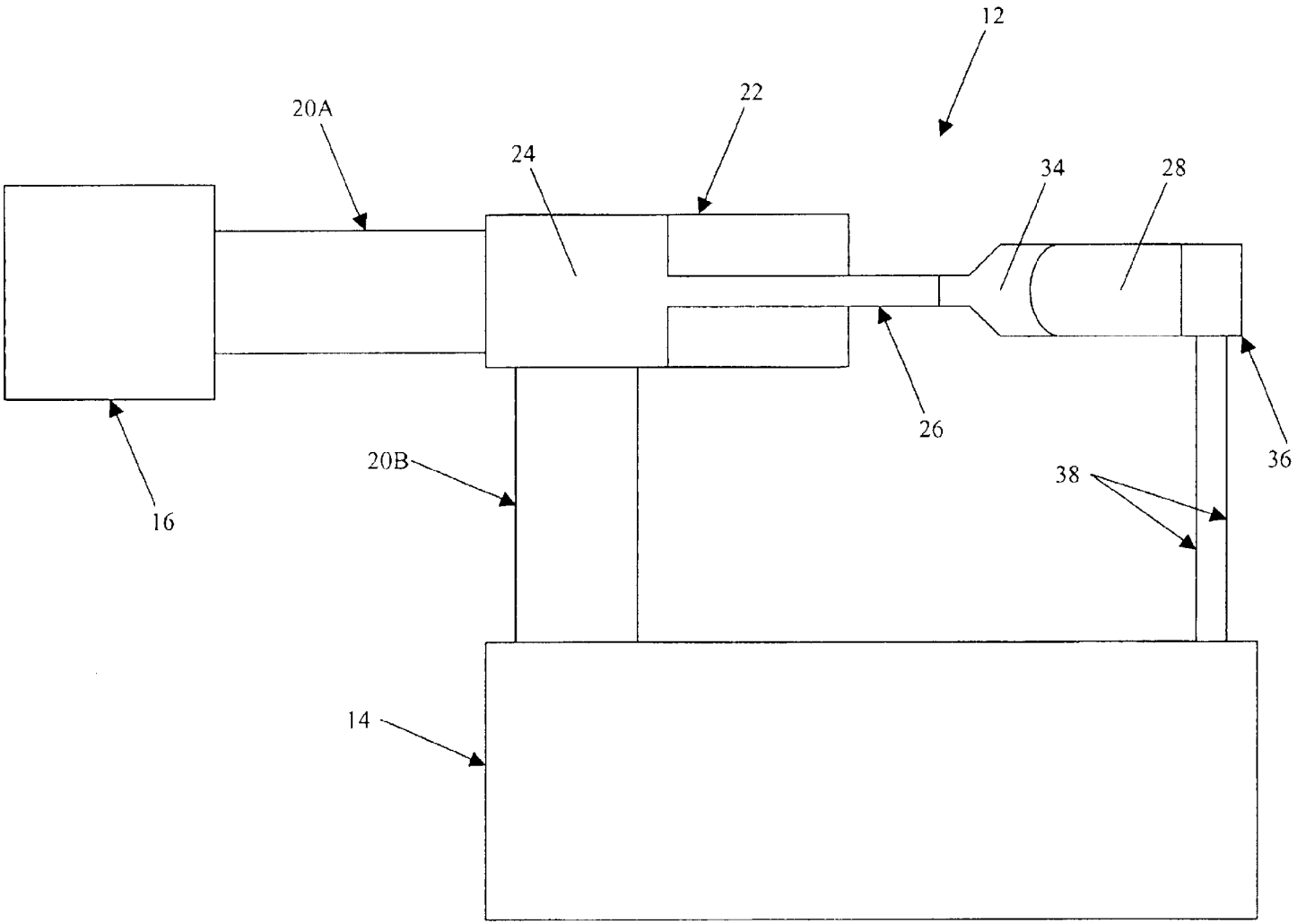
FIG. 3 shows the auto-enrichener of FIG. 2 in a closed configuration.

FIG. 3 shows the valve 22 in the closed configuration. The passage of air and fuel through the conduit 20 and the valve 22, and thus through the auto-enrichener 12, is not enabled. In such an arrangement no additional air and fuel is provided to the engine 14 through the auto-enrichener 12, and thus the engine 14 is not enriched.

As shown in FIGS. 2 and 3, the valve 22 includes a valve plug 24 that is movable between an open position, shown in FIG. 2, and a closed position, shown in FIG. 3. In the open position, the valve plug 24 does not obstruct the passage of air and fuel through the valve 22, and thus the valve 22 is in the open configuration. In the closed position, the valve plug 24 obstructs the passage of air and fuel through the valve 22, and thus the valve 22 is in the closed configuration.

In addition, as shown in FIGS. 2 and 3 the valve 22 includes a valve rod 26 connected to the valve plug 24 so that as the rod 26 moves, the plug 24 also moves.

However, such an arrangement for the valve 22 is exemplary only. Other valves 22 having other arrangements may be equally suitable.

As shown in FIGS. 2 and 3, the auto-enrichener 12 also includes a thermal expansion element 28. The thermal expansion element 28 expands as its temperature increases, and contracts as its temperature decreases. A variety of structures and compositions for the thermal expansion element 28 may be suitable. The structure and composition for the thermal expansion element 28 is described in greater detail below.

The thermal expansion element 28 is in communication with the valve 22. The communication therebetween is such that as the temperature of the thermal expansion element 28 increases, and the size of the thermal expansion element 28 likewise increases, the valve 22 is urged towards the closed configuration. Furthermore, as the temperature of the thermal expansion element 28 decreases, and the size of the thermal expansion element 28 likewise decreases, the valve 22 is urged towards the open configuration.

Depending on the particular structure and composition of the valve 22 and the thermal expansion element 28, there will be some first temperature such that when the valve 22 is at or below the first temperature the valve 22 is in the open configuration. Likewise, there will be some second temperature such that when the valve 22 is at or above the first temperature the valve 22 is in the closed configuration. For a thermal expansion element 28 having a positive coefficient of thermal expansion, the second temperature will be greater than the first temperature.

As shown in FIGS. 2 and 3, the thermal expansion element 28 engages the valve rod 26 indirectly, via a volume of oil 34. As may be seen by a comparison of FIGS. 2 and 3, when the thermal expansion element 28 increases in size, i.e. when heated, it displaces the oil 34, which in turn displaces the rod 26. This then causes the valve plug 24 to translate towards the closed position, placing the valve 22 into the closed configuration wherein it does not enable the flow 18 of air and fuel therethrough to the engine 14.

Conversely, when the thermal expansion element 28 decreases in size, i.e. as it cools, it draws in the oil 34, which in turn draws in the rod 26. This then causes the valve plug 24 to translate towards the open position, placing the valve 22 into the open configuration in which it allows the flow 18 of air and fuel therethrough to the engine 14.

In certain embodiments, the valve plug 24 may be biased toward the open position, for example by an elastic member such as a spring, by negative pressure in the oil, etc. In such an arrangement, the valve plug 24 would tend to remain in and/or move toward the open position unless it is driven towards the closed position as the thermal expansion element 28 is heated. However, such an arrangement is exemplary only.

Furthermore, this overall arrangement also is exemplary only. Other arrangements may be equally suitable. In particular, auto-enricheners 12 including but not limited to those that do not use oil 34, for example arrangements wherein the thermal expansion element 28 actuates the valve 22 directly, may be suitable.

As may also be seen from FIGS. 2 and 3, the auto-enrichener 12 includes a heater 36 that is in thermal communication with the thermal expansion element 28. The heater 36 is adapted to operate when the engine 14 operates.

For example, as illustrated the heater 36 is an electric resistance heater, and is connected by wires 38 to the engine 14. When the engine 14 runs, electrical power is directed to the heater 36 via the wires 38. As shown, the wires 38 connect to the engine 14 itself, and draw current from the electrical system of the engine 14. However, such an arrangement is exemplary only. Other arrangements may be equally suitable. In particular, arrangements wherein the heater 36 is not an electrical heater may be equally suitable.

In such arrangements, heat may be derived from other sources, such as the ambient heat of the engine 14 itself.

Regardless of the source of the heat, as the heater 36 heats the thermal expansion element 28, the thermal expansion element 28 expands, and the valve 22 is urged towards the closed configuration wherein a flow 18 of additional air and fuel is not delivered to the engine 14 therethrough. By contrast, when the heater 36 does not heat the thermal expansion element 28, the thermal expansion element 28 cools and contracts, and the valve 22 is urged towards the open configuration wherein a flow 18 of additional air and fuel is delivered to the engine 14 therethrough.

Because the heater 36 is activated when the engine 14 runs, the auto-enrichener 12 is self-controlling, and does not require activation or adjustment by the operator of the vehicle 10.

For example, when the engine 14 is cold, as when the vehicle has not been used for some period of time, the thermal expansion element 28 likewise will be cold. Consequently, the auto-enrichener 12 will deliver additional air and fuel to the engine 14 if it is started under such conditions, as may be desirable when the engine 14 is cold.

By contrast, when the engine 14 is hot, as when the vehicle has been used recently, the thermal expansion element 28 likewise will be hot. Consequently, the auto-enrichener 12 will not deliver additional air and fuel to the engine 14 if it is started under such conditions, as may be desirable when the engine 14 is hot.

Thus, because the relative temperature of the thermal expansion element 28 mimics that of the engine 14, the auto-enrichener 12 delivers or does not deliver additional air and fuel to the engine 14 as appropriate for the engine conditions.

It is noted that the temperature of the engine 14 itself is not necessarily being measured, nor is it necessary for the temperature of the engine 14 to even be known in order for the auto-enrichener 12 to operate. Furthermore, it is not necessary for the temperature of the thermal expansion element 28 to be equal to the temperature of the engine 14, or even to be approximately similar, though for some embodiments this may be the case.

It is only the relative temperatures that must correspond. That is, when the engine 14 is cold, the thermal expansion element 28 must be cold, and when the engine 14 is hot, the thermal expansion element 28 must be hot. More particularly, when the engine 14 is cold, the thermal expansion element 28 must be at some first temperature such that the valve 22 is in the open configuration, and when the engine 14 is cold, the thermal expansion element 28 must be at some second temperature such that the valve 22 is in the closed configuration.

Figure 4:
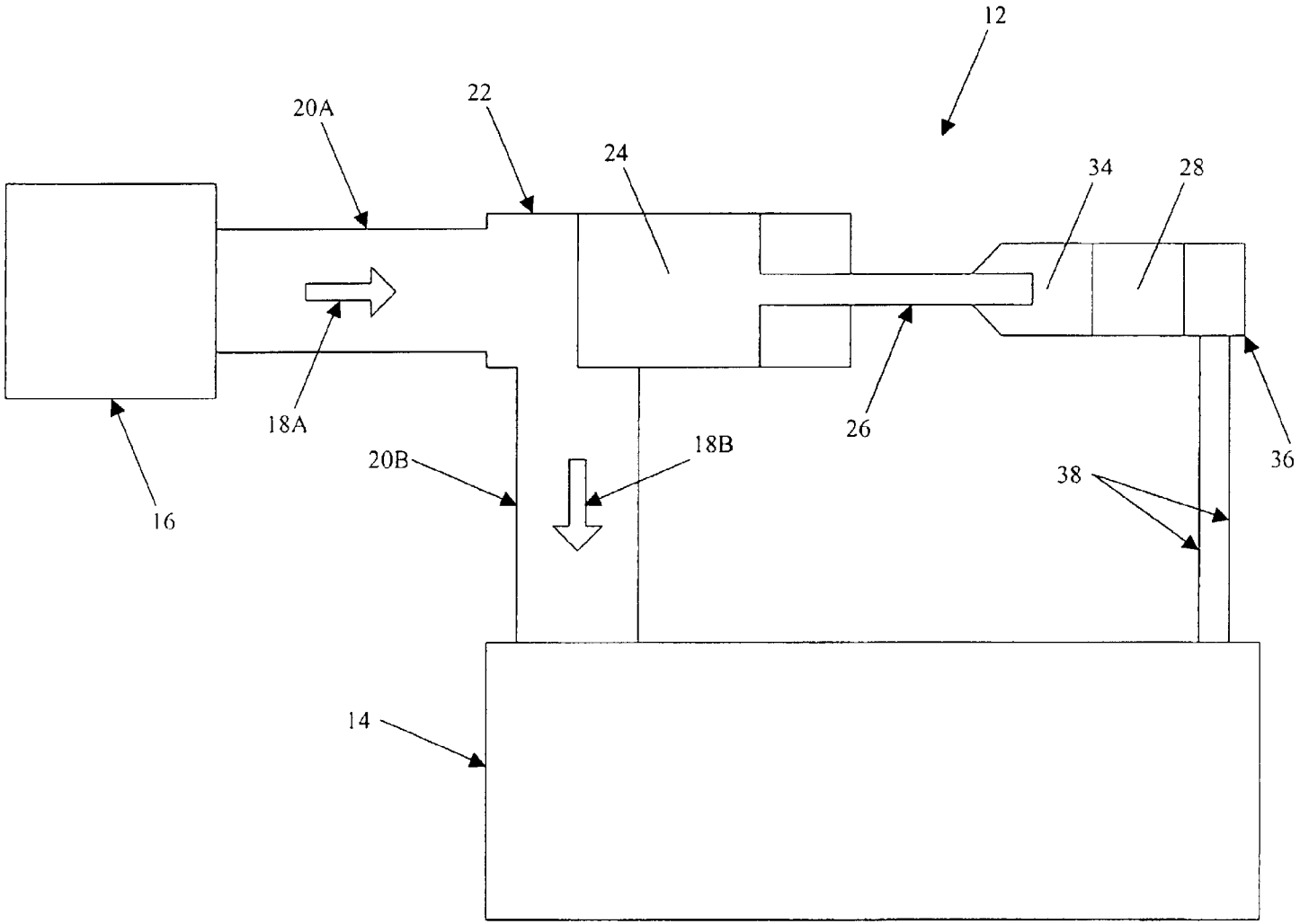
FIG. 4 shows the auto-enrichener of FIG. 2 in an intermediate configuration.

Turning to FIG. 4, the auto-enrichener 12 may be movable to and from an intermediate configuration, in addition to the open and closed configurations shown in FIGS. 2 and 3, respectively. As may be seen in FIG. 4, the thermal expansion element 28 is at some size intermediate to its small size when cold as shown FIG. 2 and its large size when hot as shown in FIG. 3. Such an arrangement may be suitable for certain embodiments, although it is exemplary only.

The intermediate size for the thermal expansion element 28 is achieved when the thermal expansion element 28 is at some third temperature intermediate to the first and second temperatures. As may be seen, in such an instance a flow 18 of additional air and fuel through the valve 22 and thus to the engine 14 via the auto-enrichener 12 is still enabled. However, a comparison of FIGS. 2 and 4 reveals that the flow 18 in the intermediate configuration is less than that in the open configuration. As illustrated, this is accomplished by having a reduced area for the conduit 20 when the valve 22 is in the intermediate configuration, as compared with the open configuration. Consequently, the rate of passage of air and fuel through the conduit 20 is less when the valve 22 is in the intermediate configuration than when the valve 22 is in the open configuration.

The intermediate configuration is achieved when the thermal expansion element 28 is warmer than in the open configuration, but cooler than in the closed configuration. This condition is obtained when the heater 36 has been operating in the past, but has not operated recently enough that the thermal expansion element 28 is still fully expanded, did not operate for a long enough period that the thermal expansion element 28 is fully expanded, etc.

It is noted that operation in the intermediate configuration may be transient. That is, the valve 22 will not necessarily stop at or hold steady in the intermediate configuration. Rather, as the temperature of the thermal expansion element 28 continues to increase, the valve 22 may continue to move towards the closed position. Thus, although the valve 22 may be in the intermediate configuration at some point or for some period of time, this should not be taken to imply that the valve 22 will remain fixed in the intermediate configuration.

It is also noted that the valve 22 may begin in the intermediate position when the engine 14 is started. For example, if the engine 14 has been operated in the past, but has been inactive for some period of time since then, the thermal expansion element 28 may have cooled sufficiently for the valve 22 to be in the intermediate configuration when the engine 14 is again started. Of course, if the period of inactivity is sufficiently long, and/or local temperatures are sufficiently low, the valve 22 might be in the open configuration when the engine 14 is started. Likewise, if the engine 14 is restarted after a relatively short time, the valve 22 might be in the closed configuration when the engine 14 is restarted.

Thus, although the valve 22 typically will tend to move towards the closed configuration as the engine operates 14, the valve 22 may be in substantially any configuration when the engine 14 is started.

Because the heater 36 operates when the engine 14 operates, the intermediate configuration thus occurs when the engine 14 is warmer than at a typical ambient temperature, but cooler than its normal operating temperature.

Thus, when the engine 14 is in such a condition, if the engine 14 is made to operate the engine 14 will be enriched, but not to the degree it would be enriched if it were started cold with the auto-enrichener 12 in the open configuration.

Therefore, again because the relative temperature of the thermal expansion element 28 mimics that of the engine 14, the auto-enrichener 12 delivers or does not deliver variable amounts of additional air and fuel to the engine 14 as appropriate for the engine conditions.

Depending on the embodiment, it may be advantageous to arrange for the auto-enrichener 12 to be continuously variable, such that the amount of additional fuel and air delivered to the engine 14 therethrough is also continuously variable depending on the temperature of the engine 14. The arrangement illustrated in FIGS. 2–4 is such an arrangement.

However, this is exemplary only. In other arrangements, the auto-enrichener 12 to be discretely variable, such that only a few different amounts of additional fuel and air are delivered to the engine 14 therethrough depending on the temperature of the engine 14.

The particular structure and composition of the thermal expansion element 28 may vary from embodiment to embodiment. As illustrated in FIGS. 2–4, the thermal expansion element 28 is of essentially uniform composition. However, such an arrangement is exemplary only.

Figure 5A:
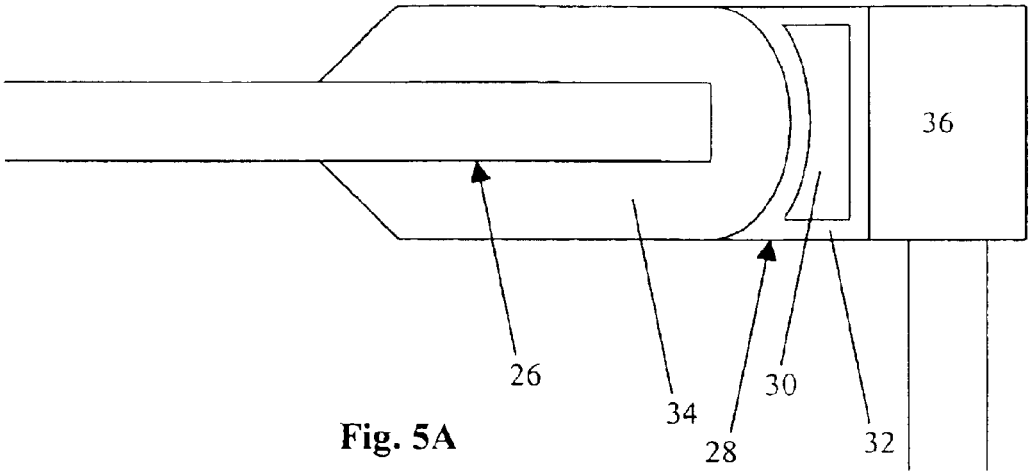
FIGS. 5A–5C show a magnified view of an exemplary embodiment of a thermal expansion element for an auto-enrichener in accordance with the principles of the present invention, with the auto-enrichener in the open, intermediate, and closed configurations respectively.
Figure 5B:
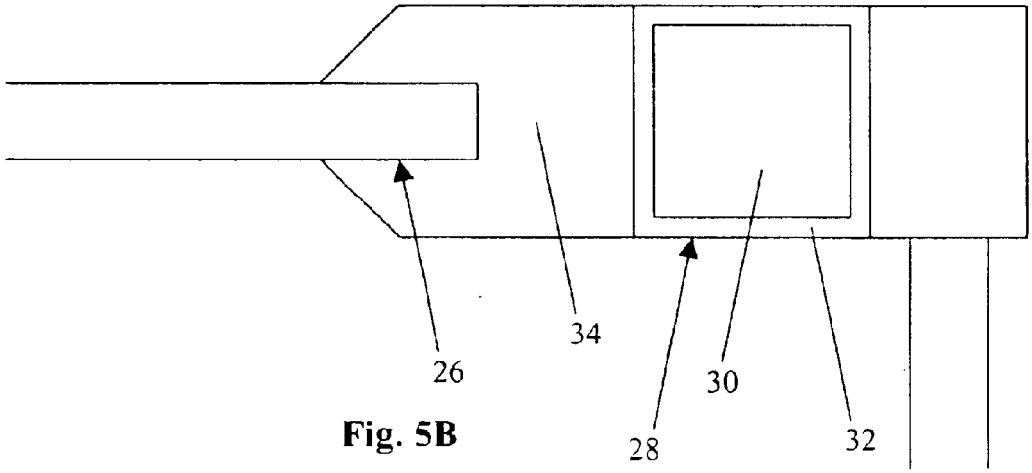
Figure 5C:
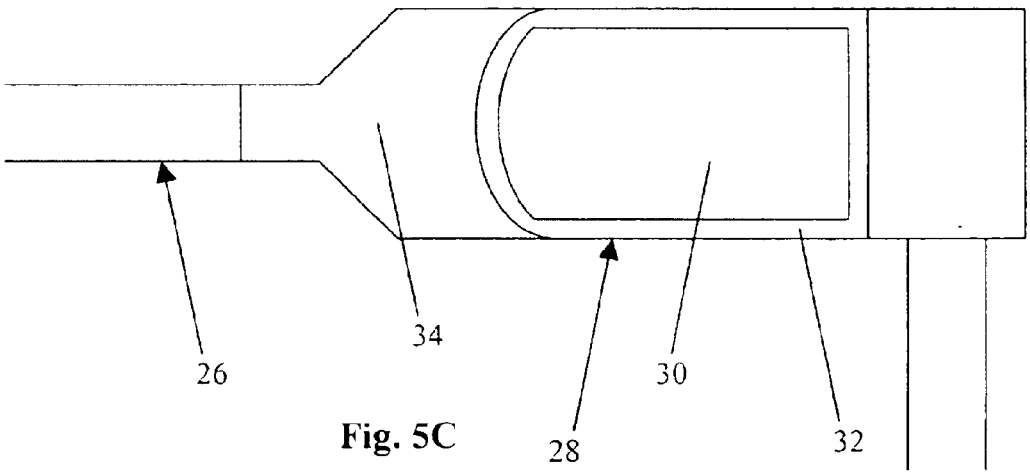

FIGS. 5A–5C show an alternative embodiment of the thermal expansion element 28. FIG. 5A shows a portion of the auto-enrichener 12 with the valve in the open configuration, with the thermal expansion element 28 having a relatively small size as when the thermal expansion element 28 is at the first temperature (cold). FIG. 5B shows a portion of the auto-enrichener 12 with the valve in the intermediate configuration, with the thermal expansion element 28 having an intermediate size as when the thermal expansion element 28 is at the third temperature (warm). FIG. 5C shows a portion of the auto-enrichener 12 with the valve in the closed configuration, with the thermal expansion element 28 having a relatively large size as when the thermal expansion element 28 is at the second temperature (hot).

As shown therein, the thermal expansion element 28 includes a liquid portion 30 disposed within a flexible solid portion 32. The liquid portion 30 has a high coefficient of thermal expansion, and thus expands and contracts to a large degree with changing temperature, as may be seen by a comparison of FIGS. 5A–5C. Thus, the liquid portion 30 is responsible for the greater part of the expansion and contraction of the thermal expansion element 28. In the embodiment shown in FIGS. 5A–5C, the flexible solid portion 32 encapsulates and contains the liquid portion 30, but does not necessarily contribute substantially to the expansion and contraction of the thermal expansion element 28.

For such a thermal expansion element 28, a variety of liquids and flexible solids may be suitable. For example, suitable liquids for the liquid portion 30 include, but are not limited to, liquid silicones. Alternatively, the liquid portion may include wax, and/or may include a mixture of wax and silicone, including but not limited to mixtures such as suspensions or emulsions of otherwise immiscible waxes and/or silicones. Suitable solids for the flexible solid portion 32 include, but are not limited to, wax. Similarly, the flexible solid portion may include wax, but alternatively may include a mixture of wax and silicone. It is to be understood that suitability of solids and liquids will depend at least in part on their particular physical properties, i.e. their relative melting and boiling points, the coefficients of thermal expansion, their relative tendency to react with one another, etc.

In the arrangement illustrated in FIGS. 5A–5C, the liquid portion is contiguous within the thermal expansion element 28. However, this is exemplary only.

Figure 6A:
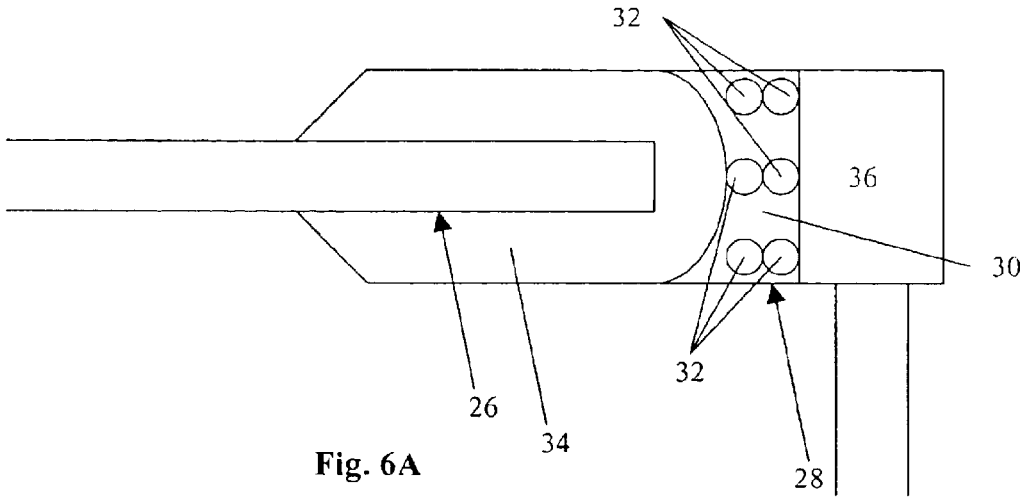
FIGS. 6A–6C show a magnified view of another exemplary embodiment of a thermal expansion element for an auto-enrichener in accordance with the principles of the present invention, with the auto-enrichener in the open, intermediate, and closed configurations respectively.
Figure 6B:
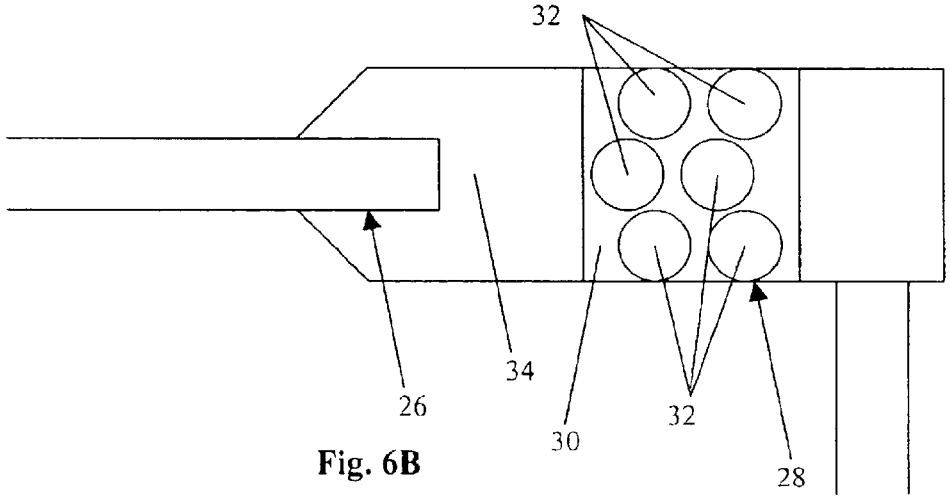
Figure 6C:
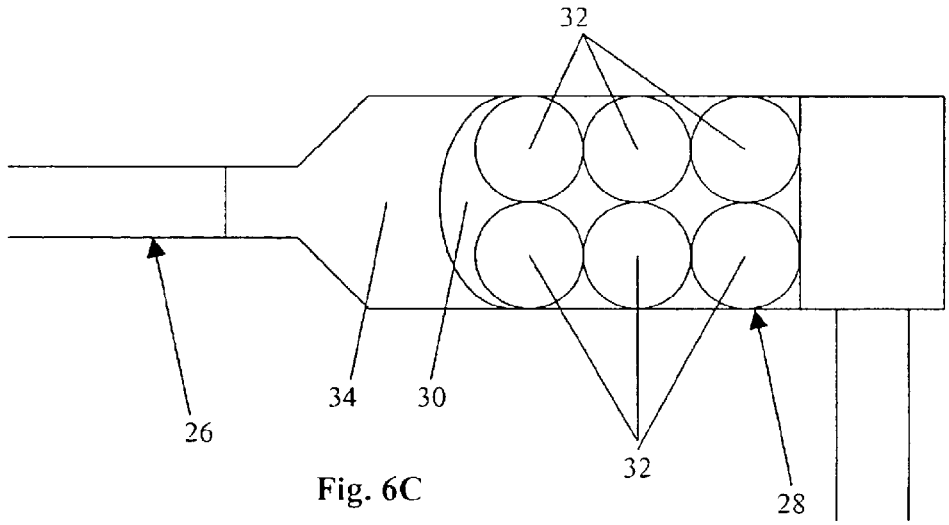

FIGS. 6A–6C show another alternative embodiment of the thermal expansion element 28. FIGS. 6A–6C generally correspond to FIGS. 5A–5C in terms of temperature and configuration of the valve 22. Also, as in FIGS. 5A–5C, in FIGS. 6A–6C the thermal expansion element 28 includes a liquid portion 30 disposed within a flexible solid portion 32.

However, while the liquid portion 30 is contiguous in FIGS. 5A–5C, in FIGS. 6A–6C the liquid portion is distributed into several discrete portions.

Despite this difference in structure, the overall performance of the thermal expansion element 28 in FIGS. 6A–6C is similar that of FIGS. 5A–5C. The liquid portion 30 again has a high coefficient of thermal expansion, and thus expands and contracts to a large degree with changing temperature. However, as may be seen by a comparison of FIGS. 6A–6C, each discrete portion of the liquid portion 30 expands and contracts with increasing and decreasing temperature. Thus, the liquid portion 30 remains responsible for the greater part of the expansion and contraction of the thermal expansion element 28. Likewise, in the embodiment shown in FIGS. 6A–6C, the flexible solid portion 32 again encapsulates and contains the liquid portion 30, but does not necessarily contribute substantially to the expansion and contraction of the thermal expansion element 28.

Thus, even given a particular material or combination of materials, the thermal expansion element 28 may vary considerably from embodiment to embodiment. Furthermore, both the structures and the compositions illustrated in FIGS. 5A–C and 6A–C and described herein are exemplary only. Other arrangements may be equally suitable.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An auto-enrichener for an engine, comprising:

an enriching conduit for carrying fuel and air to the engine;

a valve disposed in said conduit, said valve being adjustable between at least an open configuration and a closed configuration, wherein in said open configuration passage of fuel and air through said conduit is enabled, and in said closed configuration passage of fuel and air through said conduit is not enabled;

a thermal expansion element in communication with said valve, wherein said thermal expansion element expands with increasing temperature and contracts with decreasing temperature, said thermal expansion element actuating said valve such that when said thermal expansion element is at a first temperature said valve is in said open configuration, and when said thermal expansion element is at a second temperature greater than said first temperature said valve is in said closed configuration, said thermal expansion element comprising a liquid portion disposed within a flexible solid portion, wherein said liquid portion expands with increasing temperature and contracts with decreasing temperature; and a heater in thermal communication with said thermal expansion element.

2. The auto-enrichener of claim 1, wherein:

said liquid portion comprises silicone.

3. The auto-enrichener of claim 1, wherein:

said flexible solid portion comprises wax.

4. The auto-enrichener of claim 1, wherein:

said heater is an electric heater.

5. The auto-enrichener of claim 1, wherein:

said heater is in communication with said engine such that said heater heats said thermal expansion element when said engine is running, arid said heater does not heat said thermal expansion element when said engine is not running.

6. The auto-enrichener of claim 1, wherein:

said valve comprises a valve plug movably engaged with said thermal expansion element so as to be movable between open closed positions;

wherein when said valve plug is in said open position said valve is in said open configuration, and when said valve plug is in said closed position said valve is in said closed configuration; and said thermal expansion element actuates said plug between said open and closed positions so as to actuate said valve between said open and closed positions.

7. The auto-enrichener of claim 6, wherein:

said valve comprises a valve rod engaged with said valve plug and said thermal expansion element, such that when said thermal expansion element expands said rod is actuated such that said plug is translated toward said closed position, and when said thermal expansion element contracts said rod is actuated such that said plug is translated toward said open position.

8. The auto-enrichener of claim 1, wherein:

said valve is adjustable between said open and closed configuration and at least one intermediate configuration, wherein in said intermediate configuration passage of fuel and air through said conduit is enabled, and a rate of passage of fuel and air through said conduit when said valve is in said intermediate configuration is less than a rate of passage of fuel and air through said conduit when said valve is in said open configuration; and when said thermal expansion element is at a third temperature greater than said first temperature and less than said second temperature, said valve is in said intermediate configuration.

9. The auto-enrichener of claim 1, wherein the heater provides heat generated by the engine.

10. An all terrain vehicle including the auto-enrichener of claim 1.

11. A method for controlling engine enrichment in an engine, comprising:

providing an enriching conduit for carrying fuel and air to the engine;

providing a valve disposed in said conduit, said valve being adjustable between at least an open configuration and a closed configuration, wherein in said open configuration passage of fuel and air through said conduit is enabled, and in said closed configuration passage of fuel and air Through said conduit is not enabled;

providing a thermal expansion element coupled to said valve in a coaxial arrangement, wherein said thermal expansion element expands with increasing temperature and contracts with decreasing temperature, said thermal expansion element actuating said valve such that when said thermal expansion element is at a first temperature said valve is in said closed configuration, and when said thermal expansion element is at a second temperature greater than said first temperature said valve is in said open configuration, said thermal expansion element comprises a liquid portion disposed within a flexible solid portion, and wherein said liquid portion expands with increasing temperature and contracts with decreasing temperature;

providing a heater in thermal communication with said thermal expansion element; and heating said thermal expansion element with said heater when said engine is running, and not heating said thermal expansion element when said engine is not running, such while said engine is running said valve is actuated toward said closed configuration, and while said engine is not running said valve is actuated toward said open configuration.

12. The method of claim 11, wherein:

said liquid portion comprises silicone.

13. The method of claim 11, wherein:

said flexible solid portion comprises wax.

14. The method of claim 11, wherein:

said heater is an electric heater.

15. The method of claim 11, wherein:

said heater is in communication with said engine such that said heater heats said thermal expansion element when said engine is running, and said heater does not heat said element when said engine is not running.

16. The method of claim 11, wherein:

said valve comprises a valve plug movably engaged with said thermal expansion element so as to be movable between open closed positions;

wherein when said valve plug is in said open position said valve is in said open configuration, and when said valve plug is in said closed position said valve is in said closed configuration; and said thermal expansion element actuates said plug between said open and closed positions so as to actuate said valve between said open and closed positions.

17. The method of claim 16, wherein:

said valve comprises a valve rod engaged with said valve plug and said thermal expansion element, such that when said thermal expansion element expands said rod is actuated such that said plug is translated toward said closed position, and when said thermal expansion element contracts said rod is actuated such that said plug is translated toward said open position.

18. The method of claim 11, wherein:

said valve is adjustable between said open and closed configuration and at least one intermediate configuration, wherein in said intermediate configuration passage of fuel and air through said conduit is enabled, and a rate of passage of fuel and air through said conduit when said valve is in said intermediate configuration is less than a rate of passage of fuel and air through said conduit when said valve is in said open configuration; and when said thermal expansion element is at a third temperature greater than said first temperature and less than said second temperature, said valve is in said intermediate configuration.

19. An auto-enrichener for engine, comprising:

an enriching conduit defining a flow path for fuel and air to an engine;

a valve movable between a first position removed from the flow path wherein the valve enables passage of fuel and air to the engine, and a second position wherein the valve is positioned within the flow path to inhibit passage of fuel and air to the engine;

a thermal expansion element coupled to the valve, wherein the thermal expansion element expands with increasing temperature and contracts with decreasing temperature to move the valve between the first and second positions; and a heater in thermal communication with the thermal expansion element, wherein the heater heats the thermal expansion element from a first temperature associated with the first valve position to a second temperature associated with the second valve position, the first temperature being greater than the second temperature.

20. The auto-enrichener of claim 19, wherein the heater is an electric heater.

21. The auto-enrichener of claim 19, wherein said heater is in communication with the engine such that the heater heats the thermal expansion element when the engine is running, and the heater does not heat the thermal expansion element when the engine is not running.

22. A method for controlling engine enrichment in an engine, comprising:

providing an enriching conduit for carrying fuel and air to the engine;

providing a valve disposed in said conduit, said valve being adjustable between at least an open configuration and a closed configuration, wherein in said open configuration passage of fuel and air through said conduit is enabled, arid in said closed configuration passage of fuel and air through said conduit is not enabled;

providing a thermal expansion element coupled to said valve in a coaxial arrangement, wherein said thermal expansion element expands with increasing temperature and contracts with decreasing temperature, said thermal expansion element actuating said valve such that when said thermal expansion element is at a first temperature said valve is in said closed configuration, and when said thermal expansion element is at a second temperature greater than said first temperature said valve is in said open configuration;

providing an electric heater in thermal communication with said thermal expansion element; and heating said thermal expansion element with said heater when said engine is running, and not heating said thermal expansion element when said engine is not running, such while said engine is running said valve is actuated toward said closed configuration, and while said engine is not running said valve is actuated toward said open configuration.

23. A method for controlling engine enrichment in an engine, comprising:

providing an enriching conduit for carrying fuel and air to the engine;

providing a valve disposed in said conduit, said valve being adjustable between at least an open configuration and a closed configuration, wherein in said open configuration passage of fuel and air through said conduit is enabled, and in said closed configuration passage of fuel and air through said conduit is not enabled;

providing a thermal expansion element coupled to said valve in a coaxial arrangement, wherein said thermal expansion element expands with increasing temperature and contracts with decreasing temperature, said thermal expansion element actuating said valve such that when said thermal expansion element is at a first temperature said valve is in said closed configuration, and when said thermal expansion element is at a second temperature greater than said first temperature said valve is in said open configuration;

providing a heater in thermal communication with said thermal expansion element; and heating said thermal expansion element with said heater when said engine is running, and not heating said thermal expansion element when said engine is not running, such while said engine is running said valve is actuated toward said closed configuration, and while said engine is not running said valve is actuated toward said open configuration;

wherein said valve comprises a valve plug movably engaged with said thermal expansion element so as to be movable between open closed positions, when said valve plug is in said open position said valve is in said open configuration, when said valve plug is in said closed position said valve is in said closed configuration, and said thermal expansion element actuates said plug between said open and closed positions so as to actuate said valve between said open and closed positions.

24. The method of claim 23, wherein said valve comprises a valve rod engaged with said valve plug and said thermal expansion element, such that when said thermal expansion element expands said rod is actuated such that said plug is translated toward said closed position, and when said thermal expansion element contracts said rod is actuated such that said plug is translated toward said open position.

* * * * *